United States Patent [19]

Ohgami

[11] Patent Number: 4,700,182

[45] Date of Patent: Oct. 13, 1987

[54] METHOD FOR STORING GRAPHIC INFORMATION IN MEMORY

[75] Inventor: Katsuya Ohgami, Yamatokoriyama, Japan

[73] Assignee: Sharp Kabushiki Kaisha, Osaka, Japan

[21] Appl. No.: 563,508

[22] Filed: Dec. 20, 1983

[30] Foreign Application Priority Data

May 25, 1983 [JP] Japan ..... 58-93665

[51] Int. Cl.[4] ..... G09G 1/00

[52] U.S. Cl. ..... 340/750; 340/747; 340/723

[58] Field of Search ..... 340/750, 709, 747, 725, 340/729, 723

[56] References Cited

U.S. PATENT DOCUMENTS

| | | | |
|---|---|---|---|
| 3,683,359 | 8/1972 | Kleinschnitz | 340/801 |
| 3,792,462 | 2/1974 | Casey et al. | 340/726 |
| 4,203,107 | 5/1980 | Lovercheck | 340/709 |
| 4,342,029 | 7/1982 | Hofmanis et al. | 340/747 |
| 4,368,466 | 1/1983 | Dwire | 340/750 |
| 4,404,554 | 9/1983 | Tweedy, Jr. et al. | 340/726 |
| 4,451,825 | 5/1984 | Hall et al. | 340/750 |
| 4,489,317 | 12/1984 | Shiga | 340/750 |

OTHER PUBLICATIONS

Guttag et al., "Video Display Processor Simulates Three Dimensions", Electronics, Nov. 20, 1980, pp. 23–26, vol. 53, No. 25.

*Primary Examiner*—Marshall M. Curtis

*Attorney, Agent, or Firm*—Birch, Stewart, Kolasch & Birch

[57] ABSTRACT

A graphic information processing system is capable of developing graphic display information stored in data memory into graphic dot display pattern which is then written into dot map memory. Since the graphic display segments are memorized into designated areas of data memory upon being split into variable length, memory capacity can be reduced. By providing additional address memory area related to either the graphic display segment or these groups, additional graphic display information can be selected from additional addresses, and as a result, editing can be implemented very easily.

6 Claims, 10 Drawing Figures

METHOD FOR STORING GRAPHIC INFORMATION IN MEMORY

BACKGROUND OF THE INVENTION

The present invention relates to a graphic information processing unit, more particularly, to a graphic display information memory system that easily performs indexing as well as editing, while significantly reducing memory capacity requirements.

Recently, a variety of designing techniques have been developed, for example, a CAD process enabling the operator to effectively perform designing by exchanging dialogues with a computer via a graphic display, and a CAM process for performing designing related to productive operations by using computers, thus making it possible to create complex and large drawings.

Conventionally, when using any of the existing graphic display information processing units, to easily edit information such as by addition, deletion or change, the graphic display information is defined to use segments (which are groups the graphic display elements, pixels) that denote the minimum unit for composing information. For example, 1 segment of data comprising 256 bytes of a fixed data length has been stored in memory. Nevertheless, such a method for storing graphic display information in memory with a fixed data bit length results in inefficient use of the data memory area and as a result, memory capacity has to be expanded significantly.

OBJECT AND SUMMARY OF THE INVENTION

The present invention relates to eliminating the disadvantages associated with the conventional graphic information processing units described above. More particularly, it aims at providing a graphic display information memory system capable of easily indexing any desired data by first splitting either the graphic display elements or groups thereof (hereinafter graphic display segments) into variable data bit length (variable length) before storing them in specific areas of data memory, enabling the system to satisfactorily achieve a reduction of required memory capacity.

As a still further object, the present invention also provides a graphic display information memory system, which allows easier editing of graphic display information before being stored in data memory in variable length, by using a memory area of data memory for memorizing additional addresses related to either the graphic display segments, and also by selectively designating additional graphic display segments to be added to the additional addresses.

DETAILED DESCRIPTION OF THE INVENTION

Figure 1:
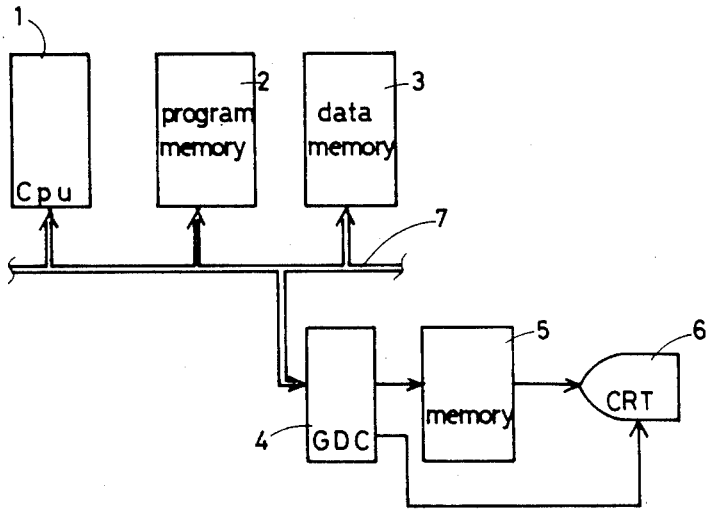
FIG. 1 is a simplified block diagram of a graphic display information processing unit as a preferred embodiment of the present invention.

FIG. 1 is a simplified block diagram of a graphic display information processing unit as a typical embodiment of the present invention.

Reference number 1 is the CPU connected to data bus 7. Said CPU 1 is controlled by program data of program memory 2 storing program data in advance. Reference number 3 is a data memory connected to data bus 7. Data memory 3 stores a variety of graphic display information under control of CPU 1. Data memory 3 also has a variety of buffers and flags. Reference numbers 4 through 6 respectively denote devices integrating a graphic display unit, which comprises a graphic display controller unit (GDC) 4, for example, UPD7220 (Nippon Electric Company) can be employed, dot map memory 5 containing a memory dot area corresponding to the display dot of a CRT display screen which is subject to raster scan, and a CRT display 6. Said GDC 4 receives the graphic display information from data memory 3 and then causes the received graphic display information to develop into display patterns that are to be memorized by the dot map memory 5. Synchronous with the raster scan applied to CRT display 6, GDC 4 reads the graphic dot display pattern from the dot map memory 5 and sends it to the CRT display as the luminance signal for displaying the designated graphic display information.

Although not illustrated, data bus 7 is connected also to the graphic display information input device and a variety of I/O terminal devices such as the keyboard via interfaces. Said graphic display information is generated by instructions, for example, from the tablet input unit specifying the kind of graph or user's program.

Figure 2:
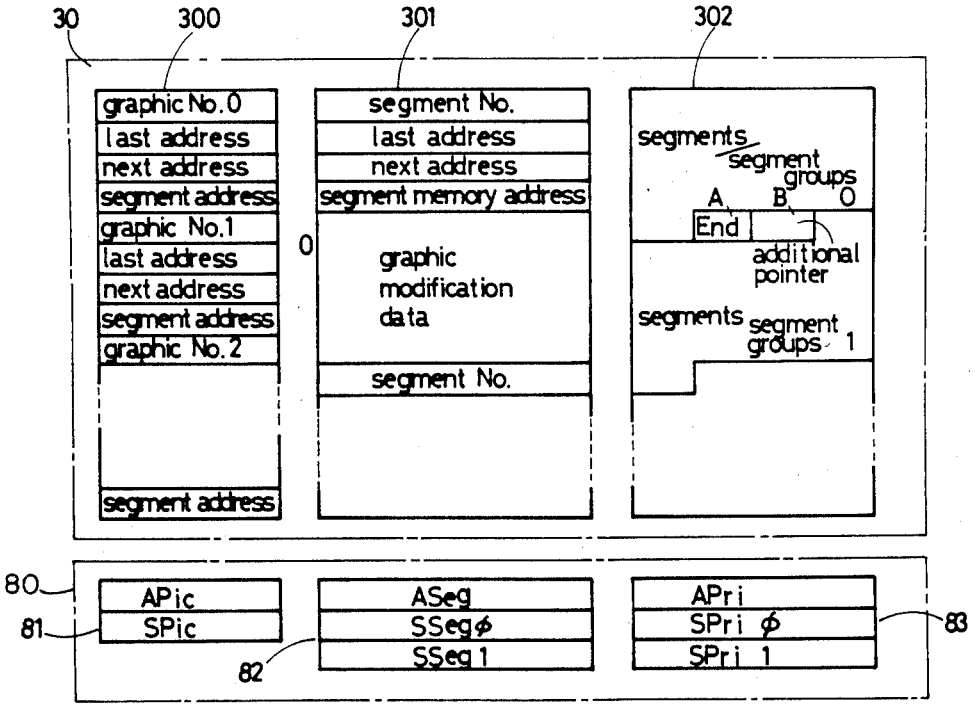
FIG. 2 is a chart showing the composition of data memory and addresses.

A preferred embodiment of the present invention provides composition of said data memory 3 as shown in FIG. 2. FIG. 2 shows the composition of memory and the memory addresses of said data memory 3. Memory 30 contains picture table 300, segment table 301, and memory 302 storing either the graphic display segments (memory 302 is hereafter called "element promitive memory"). In addition to these, memory 30 also contains an address part 80 for accessing memory. Said picture table 300 is grouped into the picture number units in dealing with one display picture, that incorporates an area for memorizing different picture numbers designated by the CPU 1, having a the last address area that stores the address values of the picture numbers that are memorized by preceding steps, the next address area that stores a memory position of the picture number set in the next step, and the segment address area that stores the first address of segment table 301 which corresponds to a given picture number. Using these areas, the picture table 300 stores picture memory data by splitting them into a fixed bit length according to picture numbers. Thus, the picture table 300 can designate the starting address of the segment table 301 corresponding to a specific picture number. Said picture table 300 also has an address buffer 81 for accessing this table. Address buffer 81 comprises an address pointer (APic) and a stack pointer (SPic).

Segment table 301 is provided for designating the starting address of the graphic display segments in segment memory 302. Segment table 301 incorporates an area storing the segment numbers sent from the CPU 1 having, a last address area that stores the last address of segment data memorized by a preceding steps, the next address area that stores the address values of segment data memorized in the next step, a segment memory address area that stores the first address of segment memory 302 that corresponds to a given segment number, and a modified graph display data memory area that stores modified parameters for one segment, for example, either an enlarged or reduced rate, an angle of revolution, a coordinate center point, etc. Segment table 301 thus stores all of these areas by splitting them in a fixed bit length according to each segment number. Segment memory address of segment table 301 thus designates the starting address of the graphic display segments in the segment memory 302. Said segment table 301 additionally contains an address buffer for accessing this table.

Figure 3:
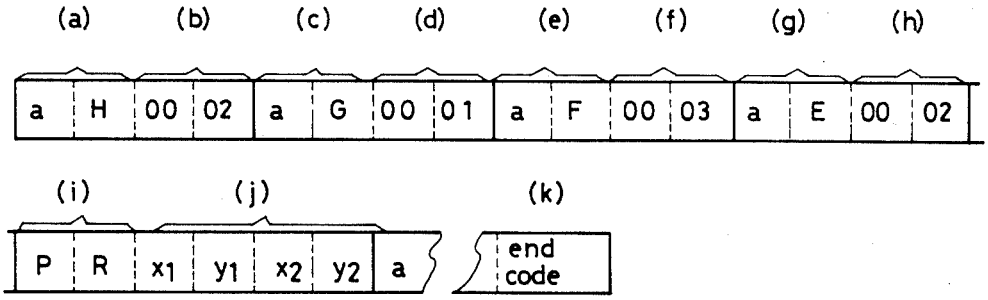
FIG. 3 is a typical example of graphic display information to be stored in variable length.

A preferred embodiment of the present invention is characterized by causing the segment memory 302 to memorize either the graphic display segments in variable length. Thus, said segment memory stores, for example, data related to either properties or coordinates of graphic display segments as shown in FIG. 3, in variable length, using a smaller memory capacity. An END code area A is formed either in the last part or the beginning part of said segment area of said segment memory 302 of FIG. 2. Compared to the data memory using a fix data length, such a data memory using variable data length can minimize the memory capacity needed. Conversely, this method of storage creates a difficulty in performing any additional editing. To eliminate such a difficulty, the present invention provides an additional pointer B, which memorizes the starting address values of the graphic display segments that are to be added. Thus, using these starting address values, addresses of the additional graphic display segments stored in the segment memory area corresponding to the additional start address area can be selectively designated. Said segment memory 302 is additionally provided with an address buffer 83 for accessing this memory. Data memory 30 thus contains a picture table 300, a segment table 301, and a segment memory 302. In addition to these, data memory 30 also contains flags A through E, X1 and X2 (which are not shown in the drawings).

Figure 4:
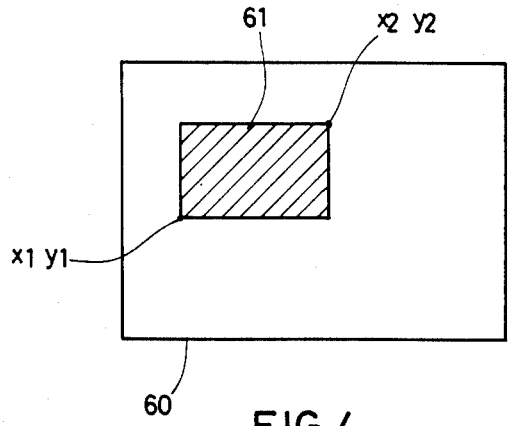
FIG. 4 is an example of the CRT display on the screen.

FIG. 3 shows a typical example of the graphic display information stored in variable length according to the kind of graphs, which contains either the graphic display segments that are to be memorized in a designated memory area of the segment memory 302. FIG. 3 denotes a graphic display information of a graph number, while the end of the code is defined by an end code. Such a graphic display information is composed, for example, of the property codes (a) through (h), of 4 bytes each denoting the kind of graph, and the coordinate data (i) and (j) of the basic graph. Codes (a) through (h) designate a graphic display segment. If a plurality of segments follow, they can also be memorized in succession. In this case, codes (a), (c), (e), and (g) respectively indicate the graph property commands, whereas codes (b), (d), (f), and (h) indicate the further limitations of the graph property commands. Code (b) indicates the coordinate command, which is followed by a coordinate data (h). Details of commands are shown below.

a—Property command
P—Coordinate command
H—Full coloring code
G—Full coloring color code
F—Frame command
E—Frame color code
R—Rectangular code Therefore, (a) code "aH" denotes the property of the fully colored graphs, (b) code "0002" denotes full-coloring of inclined lines, (c) code "aG" denotes the property of the fully-coated colors, while "0001" denotes red color. (e) code "aF" denotes the property of the frame line, and (f) code "0003" denotes a continuous line. (g) code "aE" denotes the property of the frame line color, (h) code "0002" indicates green color of the frame line color kind. (i) code "PR" denotes the rectangular coordinate code of the basic graph, and (j) code x1, y1, and x2, y2 respectively denote the coordinate values of the CRT display. These graphic display data stored by the segment memory 302 are supplied to the graphic display control unit 4, and then these data are developed into graphic dot display patterns to be displayed on the CRT display screen as shown in FIG. 4. In FIG. 4, reference number 60 is the CRT display screen, and 61 is an example of picture displayed by using the graphic display data of FIG. 3. This Figure discloses that the coordinates which establish the boundary points and; code (a) calls for coloring the graphs; code (b) calls for inclined lines; code (c) and code (d) provide the color for those lines; codes (e) and (f) provide the continuous line frame; and codes (g) and (h) produce the color of the frame. Lineup of these codes are predetermined by the CPU 1 and GDC 4 before the designated codes are displayed.

Figure 5:
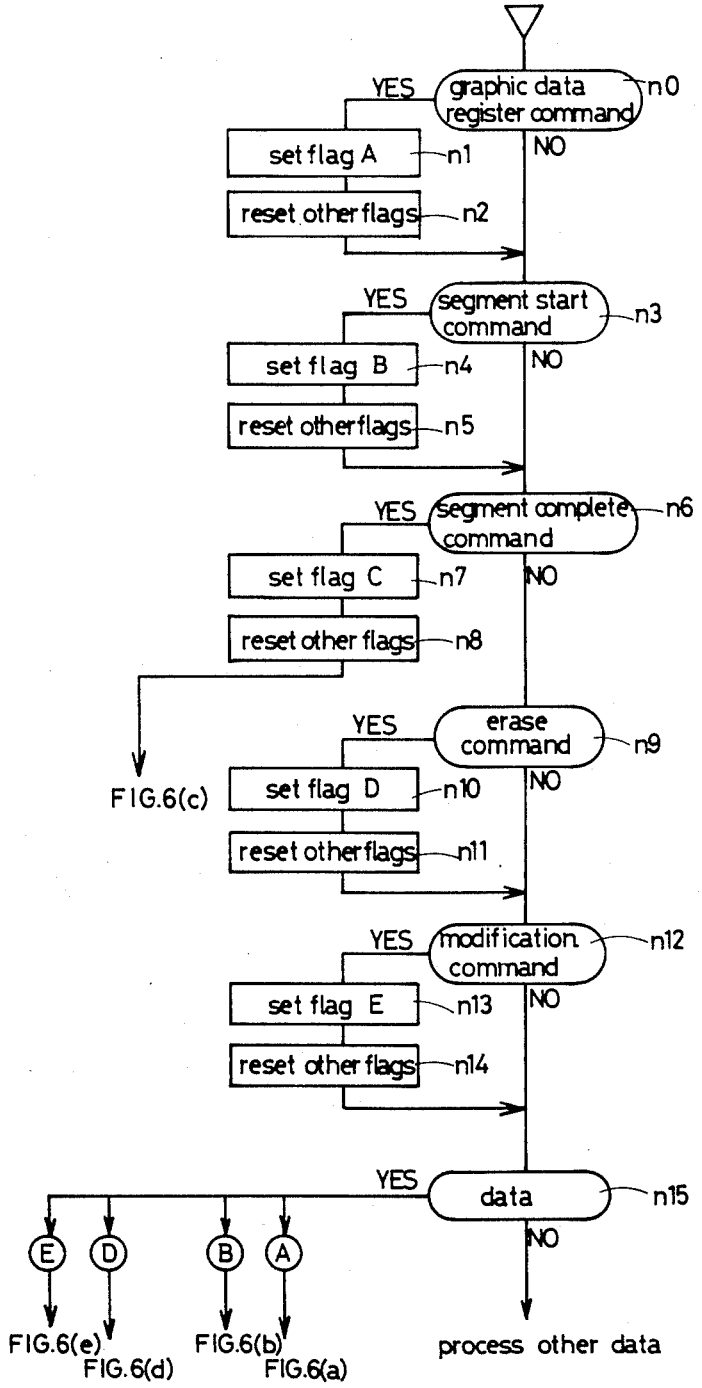
FIGS. 5 and 6*a*, 6*b*, 6*c*, 6*d* and 6*e* respectively show operational flowcharts.
Figure 6:
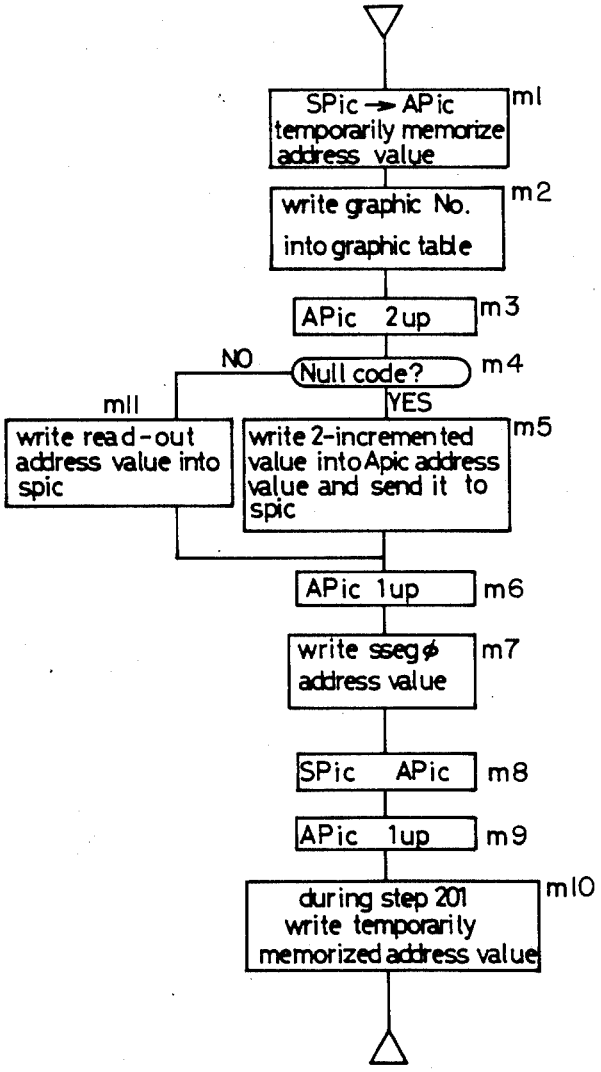
Figure 6:
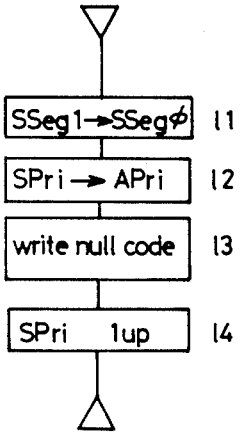

Next, in reference to flowcharts (a) through (f) of FIGS. 5 and 6, operations of the graphic display memory system as a preferred embodiment of the present invention are described below. CPU 1 outputs the designated codes according to the program of the program memory 2 and executes operations of flowchart shown in FIG. 5 by causing the data memory 3 to output the needed data.

(a) When displaying a new graphic display information The CPU 1 first judges the graphic display data command (n0), and then activates flag A in the data memory and simultaneously resets other flags B through E. Upon receipt of a designated graphic number, programmed operation proceeds from step n15 to step m1 shown in FIG. 6(a). In step m1, the stack pointer SPic of the address buffer 81 designates the position of the first location of an available memory area of the segment table 300. The CPU 1 then transfers this address value to the address pointer APic, while depositing this value in another buffer temporarily (m1). Then, according to the APic address number, data memory 30 memorizes the graphic number sent to a proper address of the picture table 300 m2. Next, the APic address value is incremented by an amount corresponding to 2 locations m3. This enables the CPU 1 to determine that the corresponding location remains in "Null" code, i.e., the CPU 1 identifies the new area from the serial areas. If such an area is erased from the serial areas of the picture table 300, an address value of the next memory area will be memorized in said area (Next). If "Null" code exists, the program proceeds to step m5 to permit the location address value incremented from the APic address value by 2 locations, i.e., the first address of the next area is memorized before being sent to SPic.

If "Null" code is not present, the existing value is read and then sent to SPic (m11). During these steps mentioned, SPic will memorize the next step address value followed by the graphic number sent to the memory area. Next, an address value of SSegØ generated by incrementing APic address value by one, i.e., the first address of the area of segment table 301 to be used for storage, will be memorized as the corresponding segment the address. Next, address value of SPic is transferred to APic and the APic address value is incremented by one location, and finally, the CPU memorizes the address value that was temporarily memorized during step m1 and uses it as the last address, also stored in picture table 300 (m6 through m10).

Figure 6B:
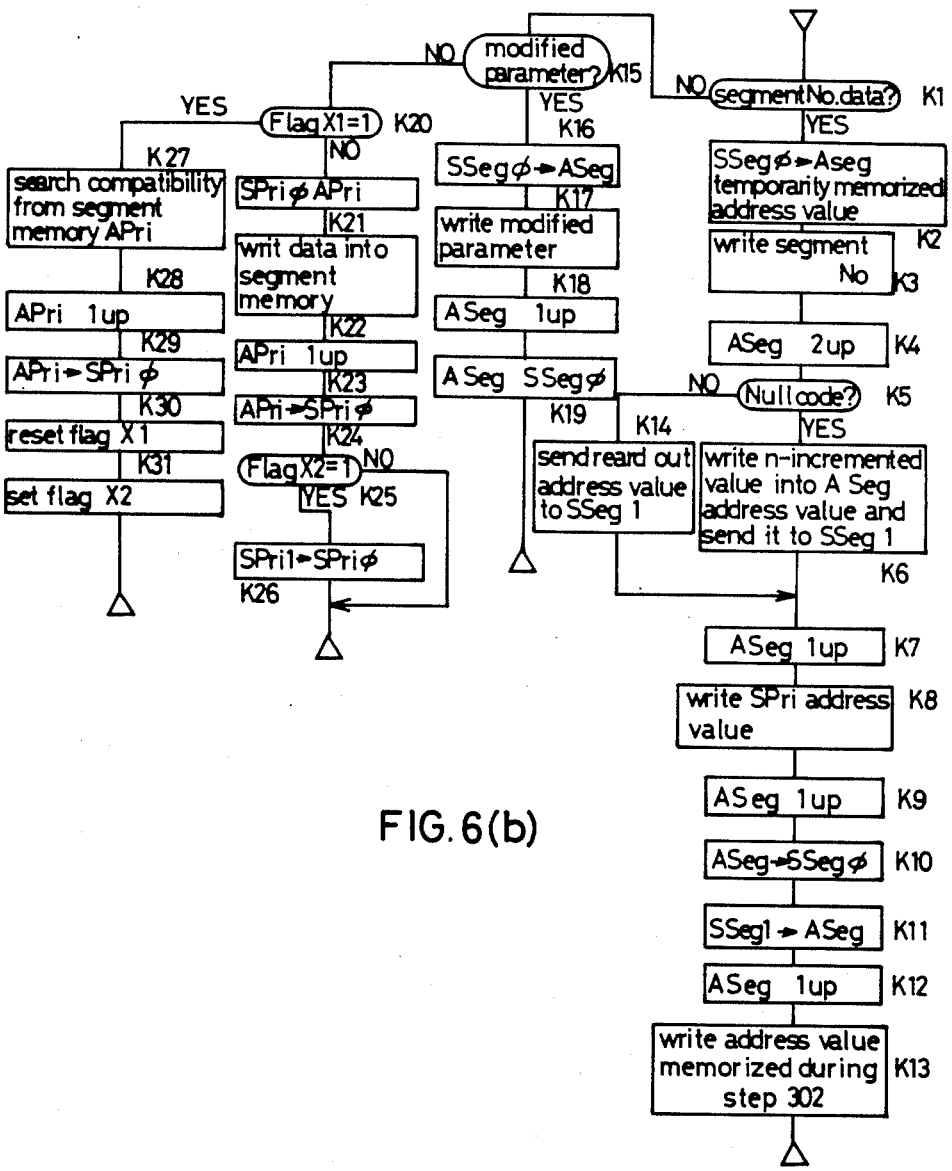
Figure 6:
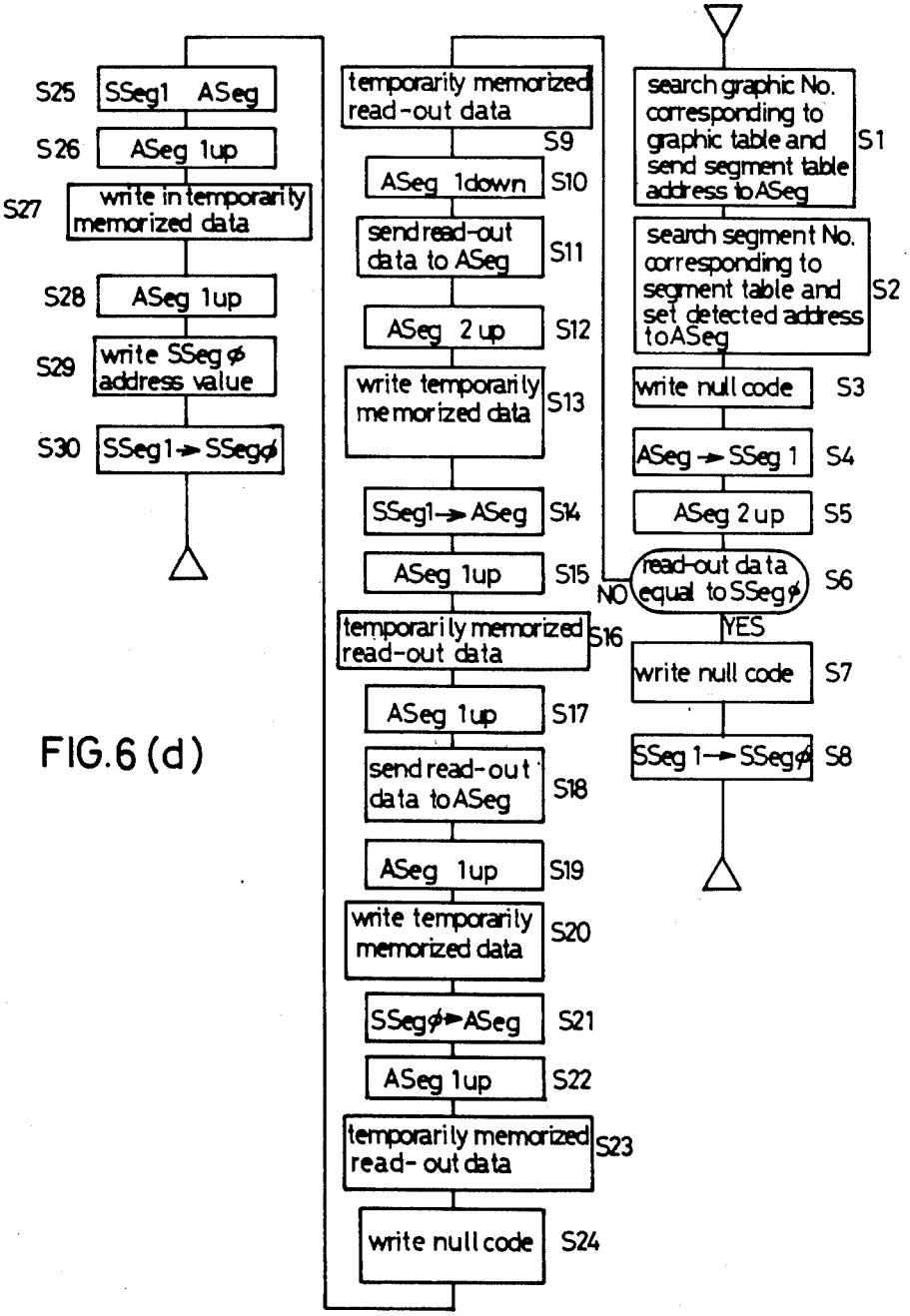

(b) Before supplying the segment number and the modified picture information, the CPU 1 outputs the segment start command. In FIG. 5, this command activates flag B during step n3, while resetting other flags A, C, D, and E (n3 through n5). Next, the CPU 1 outputs the designated segment number so that the program will proceed from step n15 to the steps shown in FIG. 6(b). In the steps of FIG. 6(b), the program proceeds from step k1 to k2 so that the SSegØ address value, i.e., the first address value in an area to be used for storage in the segment table 301 will be transferred to ASeg, and at the same time, the CPU 1 temporarily deposits this value in another buffer. The segment number output from the CPU 1 is also memorized. Then, the address value of ASeg is incremented by 2 locations, and then, as was done during step m4 of step (a) shown in FIG. 6, the CPU 1 judges if "Null" code exists. If the "Null" code is identified, the CPU 1 memorizes the first address of the new area of the serial areas of the segment table 301 being also the next step area which has been incremented by an amount corresponding to n-location. The CPU 1 then sends this address to SSeg1 (k6). If the "Null" code is absent, the first address value will be first sent to SSeg1, and then the CPU 1 causes the address value of ASeg to increment by one location and then memorizes the first address of an area expected to be used for storage in the segment memory 302 as the segment memory address (k7 and k8). Next, the CPU 1 causes the address value of ASeg to increment by one location, transfers the data of ASeg to SSegØ and the data of SSeg1 memorizing the foremost address of the next area to ASeg so that ASeg can increment its value by one location. In other words, the last address location is designated (k9 through k12). The CPU 1 then writes the address memorized during said step k2. The CPU 1 then receives the modified parameters in succession, which are then sent to the segment table 301 during steps k15 through k19 for storage. The CPU 1 then receives the graphic display data shown in FIG. 3, which are then memorized in areas corresponding to the segment memory 302 during steps k20 through k25. As soon as the designated graphic data have been completely registered via the operations thus described, the segment completed command is generated so that flag C is activated during steps n6 through n8 shown in FIG. 5, while resetting other flags A, B, D, and E. Program then proceeds to the steps of FIG. 6(c), memorizing "Null" code in the last location of the segment memory 302. This location will store the first address value of an area to be used for memorizing any additional graphic display data. Graphic display data being thus registered, the CPU then sequentially reads the segment memory 302 according to the segment table 301 for supplying data to GDC4, which then develops these data into the designated graphic dot display patterns for storage into the dot map memory 5 before eventually being displayed on the CRT dislay screen.

(c) When erasing and modifying the registered graphic data, the CPU 1 outputs an erase command so that flag D is activated during steps n9 through n11, while all other flags are reset. Next, segment numbers requiring erasure are supplied to guide the operation to enter the steps of FIG. 6(d). First, graphic number containing the segment number to be first erased is output. The CPU searches the picture table 300 to detect the area corresponding to the erasable number. This data is sent to the address value ASeg of the segment table 301 (step S1). Then, the erase command searches the segment table corresponding to ASeg to detect the erasable segment. This address value is then set in ASeg (step S2). Then, "Null" code is stored in the segment number location being set. SSeg1 then memorizes the location address erased by ASeg-SSeg 1. Next, address values of ASeg are incremented by 2 locations (Next address), while the CPU 1 judges if the read-out address value is identical to SSegØ, or not.

If both are identical, SSegØ should show a new area of serial areas, indicating that it corresponds to the newest graphic pattern registered containing segments to be erased. This enables the operation to proceed to step S7, where the "Null" code is memorized. In other words, the next address of the erasable segment is erased (S7). Next, designate SSeg1 (the foremost address of the erasable segment) as the area to be registered next. If the segment thus erased corresponds to an area en route the serial tables, a disaccord will take place during step S5, and then the operation will proceed to step S9. Then, the read-out next address value is temporarily stored and decrement the address value of ASeg by one location during steps S9 and S10. This means that a location address that memorizes the address value preceding the erasable segment will be memorized by ASeg. Next, ASeg address value is incremented by two locations (during steps S11 and S12), i.e., the next address location is indicated. Then, the address value memorized during step S9 will be memorized in said location. In other words, by skipping the erasable segment area, the address value of the next segment area will be memorized as the next address value. Next, the foremost address of the segment that was present in the position two steps before the skipping of erasable segment will be memorized in the last address location of the segment area next to the ersable segment while executing steps S14 through S20. Next, steps S21 through S30 are executed to allow the erased segment area to exist as a new segment area to be registered at a location that precedes the newly registered segment area being present. As a result, the last address data memorized by the newly registered area will be memorized by the last address location of the erased segments.

Address value of the newly registered area will be memorized in the next address location of the erased segment area. Thus, by erasing the segment table, segment memory cannot be read out practically, and thus the graph will be erased.

Next, procedures for modifying data in the segment memory 302 are described below.

Figure 6E:
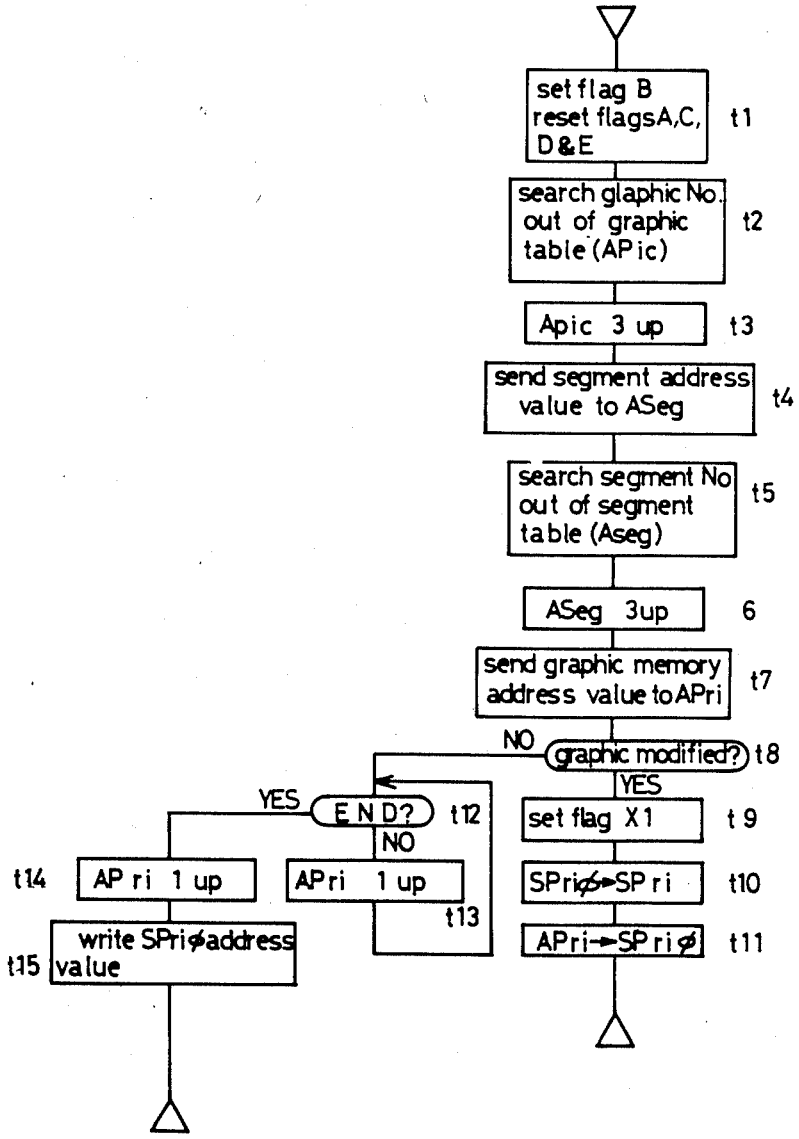

When modifying data, the CPU 1 outputs a modification command, which then activates flag E and resets flags A, B, C, and D during steps n12 through n14. Then, the CPU 1 outputs both the graphic and segment numbers of the graph to be modified, thus enabling the steps of FIG. 6(e) to be executed. Flag B is activated, while all other flags are reset (step t1). Then, as was described earlier, area of the designated graphic number in the graphic table 300 is searched, while the area of the segment number is also searched out of the segment table 301 during steps t2 through t7. If the modification is for adding graphic display data, operation of step t8 will proceed to step t12, whereas if the graphic display data must be modified, operation of step t8 will proceed to step t9, activating flag X1. Then, SPriØ designating a location memorizing a new graphic display data is transferred to Spri1, and then causes the Apri, which is the foremost address of the area of the segment memory 302 selected by the above operation, to be memorized by SpriØ. After these operations are completed, the CPU 1 outputs the property data requiring modification. Since flag B is being activated, operation will proceed to the steps of FIG. 6(b), and then operation proceeds from step k20 to k27. While the operation is executed between steps k27 and k31, property data is searched out of the segment memory 302. After being detected, the position of property data is set at SpriØ, thus setting flag X2 and resetting flag X1. Then, the CPU 1 outputs the code designating values to be modified. Such a code is written into data memory while step enters k20 through k21. Address value SPri1 is then converted into SpriØ, which is used for setting a new graphic display data in memory area. To add a new graphic display data, operation proceeds from step t8 shown in FIG. 6(d) to step t12, and so the END code of an area of segment memory 302 is detected. This causes the address value SpriØ of a new area to be memorized into the next location in which "Null" code is being stored. Additional graphic display data from the CPU 1 are then sequentially stored in memory during steps k20 and k21 shown in FIG. 6(b). As a result, graphic display data can be either modified or added as required. The above preferred embodiment has been described in reference to the CRT display, however, the present invention is not limitative of the CRT display, but can also be applied to a variety of printers as well.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. An apparatus for storing, processing and displaying graphic display information of a plurality of graphic displays, each said display haing a plurality of display picture units, comprising:

means for dividing said graphic display information into segments of data, each said segment of data describe a portion of a said picture unit;

data memory means for storing said graphic display information, said data memory means comprising, segment memory means for storing said segments of data at segment addresses within said segment memory means, segment memory buffer means, operatively connected to said segment memory means, for enabling manipulation of said segments of data in said segment memory means, segment table means for storing first address data, said first address data including said segment addresses of each of said segments of data stored in said segment memory means, segment table buffer means for enabling manipulation of said first address data in said segment table means, graphic table means for storing second address data, said second address data including data specifying addresses in said segment table means containing said first address data, and graphic table buffer means for enabling the manipulation of said second address data in said graphic table means;

processing means for accessing said graphic table means to access selected said second address data contained therein, said processing means further using said selected second address data to access said segment memory table means to thereby recall selected said first address data, said processing means further using said selected first address data to access said segment memory means to recall selected segments of data stored at segment specified by said selected first address; and display means responsive to said graphic display information under control of said processing means, for displaying at least a selected one of the plurality of graphics in accordance with said segments of data accessed by said processing means wherein said segment memory means includes a first pointer designating an end code area and a second pointer storing starting addresses of additional segments selectively designated to be added to said selected segments recalled by said processing means in accordance with said selected first address data.

2. The apparatus of claim 1 wherein said graphic table buffer means includes an address pointer and a stack pointer, said pointers being used to access data positions in said graphic table means.

3. The apparatus of claim 1 wherein said graphic table means stores second address data for each of the plurality of graphic displays.

4. The apparatus of claim 3 wherein said second address data for each of the plurality of graphic displays further includes addresses in said graphic table means of others of the plurality of graphic displays.

5. The appratus of claim 1 wherein said graphic table stores first address data for each of said segments of data.

6. The apparatus of claim 5 wherein said first address data further includes graphic modifications for a selected one of said segments of data, and also includes addresses in said segment table means of first address data for others of said segments.

* * * * *